US007743814B2

(12) United States Patent
Woodward et al.

(10) Patent No.: US 7,743,814 B2
(45) **Date of Patent: *Jun. 29, 2010**

(54) SCREEN ASSEMBLY FOR OUTWARDLY PROJECTING WINDOW

(75) Inventors: Bradley D. Woodward, Warroad, MN (US); Rebecca M. Huff, Warroad, MN (US); Russell A. Berstler, Warroad, MN (US); Ronald H. Pederson, Baudette, MN (US)

(73) Assignee: Marvin Lumber and Cedar Company, Warroad, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/678,968

(22) Filed: Feb. 26, 2007

(65) Prior Publication Data

US 2007/0137796 A1 Jun. 21, 2007

Related U.S. Application Data

(63) Continuation of application No. 10/933,686, filed on Sep. 3, 2004, now Pat. No. 7,182,119.

(51) Int. Cl.
*E06B 7/22* (2006.01)

(52) U.S. Cl. ..... 160/40; 160/102; 49/484.1; 49/489.1

(58) Field of Classification Search ..... 160/40, 160/43, 90, 102, 41, 42; 49/475.1, 484.1, 49/489.1, 496.1, 504

See application file for complete search history.

(56) References Cited

U.S. PATENT DOCUMENTS 2,261,941 A 11/1941 Persson (Continued)

FOREIGN PATENT DOCUMENTS

EP 0763643 B1 8/1999

(Continued)

OTHER PUBLICATIONS

"D+HE Ventline-Room-Controller", Brochure from D + H Mechatronic AG, Ammershek/Hamburg, Germany, published Mar. 2004,4 pages.

(Continued)

*Primary Examiner*—David Purol
(74) *Attorney, Agent, or Firm*—Schwegman, Lunberg & Woessner, P.A.

(57) ABSTRACT

A deformable screen for a window assembly including a sash movably coupled to a frame. The sash is moveable in a substantially horizontal direction relative to the frame. The deformable screen is coupled to the sash and includes at least one engagement portion slidably engaged against the frame. A spring member is coupled to the engagement portion and applies a restoring force to the engagement portion to seal it against the frame. In one option, the spring member includes a foam membrane. A method for making a screen assembly includes providing a frame and a sash disposed within the frame. A spring member is coupled around the sash and at least one engagement portion is coupled to the spring member. The engagement portion extends between the spring member and the window frame, in one option. In another option, the at least one engagement portion is slidably engaged against the frame.

28 Claims, 10 Drawing Sheets

U.S. PATENT DOCUMENTS

| | | | | | |
|---|---|---|---|---|---|
| 2,263,813 | A | * | 11/1941 | Mason | 160/40 |
| 2,270,202 | A | | 1/1942 | Persson | |
| 2,311,413 | A | | 2/1943 | Persson | |
| 2,374,618 | A | | 4/1945 | Perreton | |
| 2,963,754 | A | | 12/1960 | Herman | |
| 3,001,251 | A | | 9/1961 | Johnson | |
| 3,101,135 | A | | 8/1963 | Neal et al. | |
| 3,238,573 | A | | 3/1966 | Pease, Jr. | |
| 3,378,958 | A | | 4/1968 | Parks et al. | |
| 3,448,543 | A | | 6/1969 | Multer | |
| 3,903,949 | A | | 9/1975 | Aris | |
| 4,393,754 | A | | 7/1983 | Hough | |
| 4,394,044 | A | | 7/1983 | Hough | |
| 4,395,939 | A | | 8/1983 | Hough et al. | |
| 4,702,518 | A | | 10/1987 | Paerisch et al. | |
| 4,794,730 | A | | 1/1989 | Fischbach et al. | |
| 4,802,307 | A | | 2/1989 | Schmidt | |
| 4,803,808 | A | | 2/1989 | Greisner | |
| 4,829,710 | A | | 5/1989 | Schmidt | |
| 4,845,891 | A | | 7/1989 | Fischbach | |
| 4,866,882 | A | | 9/1989 | Cappello | |
| 4,969,291 | A | | 11/1990 | Camara | |
| 5,174,065 | A | | 12/1992 | Schlicht | |
| 5,375,376 | A | | 12/1994 | Scott | |
| 5,408,784 | A | | 4/1995 | Wruck et al. | |
| 5,694,996 | A | | 12/1997 | Vigenberg et al. | |
| 6,070,637 | A | | 6/2000 | Jancan | |
| 6,260,305 | B1 | | 7/2001 | Joyce | |
| 6,598,348 | B2 | | 7/2003 | Palicki | |
| 6,941,699 | B2 | | 9/2005 | Parsons | |
| 6,966,590 | B1 | | 11/2005 | Ksiezopolki et al. | |
| 7,182,119 | B2 | * | 2/2007 | Woodward et al. | 160/40 |
| 7,325,359 | B2 | | 2/2008 | Vetter | |

FOREIGN PATENT DOCUMENTS

| | | |
|---|---|---|
| EP | 0811741 | 12/2001 |
| EP | 0823522 B1 | 9/2002 |

OTHER PUBLICATIONS

Curtis, D. J., et al., "Window Drive Mechanism", U.S. Appl. No. 10/933,817, filed Sep. 3, 2004, 34 Pages.

Woodward, B. D., et al., "Screen Assembly for Outwardly Projecting Window", U.S. Appl. No. 10/933,686, filed Sep. 3, 2004, 44 Pages.

U.S. Appl. No. 10/933,817 Non-Final Office Action mailed May 2, 2008, OARN, 19 Pgs.

U.S. Appl. No. 10/933,817, Response filed Oct. 1, 2007 to Restriction Requirement mailed Aug. 31, 2007, 8 pages.

Restriction Requirement Mailed Aug. 31, 2007 in U.S. Appl. No. 10/933,817, RERR, 3.

U.S. Appl. No. 10/933,686, Non Final Office Action mailed Jul. 6, 2006, 5 pgs.

U.S. Appl. No. 10/933,686, Notice of Allowance mailed Dec. 15, 2006, 4 pgs.

U.S. Appl. No. 10/933,686, Response filed Oct. 6, 2006 to Non Final Office Action mailed Jul. 6, 2006, 14 pgs.

U.S. Appl. No. 10/933,817, Response filed Nov. 3, 2008 to Non Final Office Action mailed May 2, 2008, 8 pgs.

* cited by examiner

SCREEN ASSEMBLY FOR OUTWARDLY PROJECTING WINDOW

RELATED APPLICATION

This document is a continuation under 37 C.F.R. 1.53(b) of U.S. patent application Ser. No. 10/933,686 filed Sep. 3, 2004 (now U.S. Pat. No. 7,182,119, issued Feb. 27, 2007), which application is incorporated herein by reference and made a part hereof.

TECHNICAL FIELD

Window screens and in particular to a deformable window screen that extends between an outwardly projecting window sash and the window frame.

BACKGROUND

Many of the current screens used with windows having sashes that project horizontally relative to the frame are complex assemblies that are unattractive when the sash is open. In some instances, these screens are joined to both the frame and the sash. This type of installation is expensive and labor intensive. Additionally, in some examples the screen systems are bulky and require additional space to store the screen when not in use.

Screens with a pleated construction are one example of a screen system useable with horizontally projecting windows. These pleated screens have an accordion type texture and extend between the sash and frame as the sash is projected out from the frame. One disadvantage of this type of screen is that the pleats of the screen are unattractive when the window is extended. Moreover, the screen is coupled to the sash and the frame, which requires additional labor whether in manufacture or during installation.

Screens with a rolled configuration are another example of a screen system used with horizontally projecting windows. The screen is kept in a roll while the sash is in a closed position. The leading edge of the screen is coupled to the sash, and the roll is coupled to the frame. When the sash is moved out and away from the frame, the screen unrolls as the leading edge of the screen is moved with the sash. The size of the roll and corresponding visibility of the screen apparatus are a disadvantage with this type of screen. Additionally, like the pleated screen, a rolled screen is coupled to the frame and the sash. Additional labor and cost is necessary for the installation of a rolled screen during manufacture or installation of the window.

What is needed is a screen system that overcomes the shortcomings of previous screen systems. What is further needed is a screen system that is concealable, decreases labor costs and installation time, and is compact.

SUMMARY

A window assembly includes a frame and a sash movably coupled to the frame and the sash is moveable in a direction substantially horizontal with respect to the frame. A deformable screen is coupled to the sash. The deformable screen includes at least one engagement portion to traverse against the frame and a spring member coupled to the engagement portion. The spring member applies a restoring force to the engagement portion to seal it against the frame. In one option, the spring member and engagement portion are integral and include a foam membrane. In another option, the spring member is a deformable membrane (e.g., a foam membrane) coupled between the sash and the engagement portion and the deformable membrane applies a restoring force to slidably engage the engagement portion to the frame. In yet another option, the spring member is a leaf spring that applies a torsional restoring force to slidably engage the engagement portion to the frame.

Several options for the window assembly follow. In one option, the foam membrane is adhered to a support panel, and the support panel is coupled to the sash. The support panel, in another option, includes a deformable projection retained within a channel of the sash. Optionally, a support panel is coupled to the leaf spring, and the support panel includes a deformable projection retained within the channel of the sash. In still another option, the foam membrane is slidably coupled to the frame. In another option, the engagement portion includes openings. Optionally, a screen material is disposed within the openings. The engagement portion is a deformable membrane extending from the spring member, in one option. In another option, the engagement portion is disposed around the outer perimeter of the sash and the engagement portion extends between the sash and the frame. In yet another option, the engagement portion extends substantially continuously around the sash. The engagement portion is in substantially continuous engagement around an inner perimeter of the frame, in still another option. The sash optionally includes at least one corner and the engagement portion has at least two ends at the corner. At least one foam plug is coupled to a minimum of two ends of the engagement portion, in one option, and extends therebetween. Optionally, the at least one foam plug is coupled to the sash or frame. In another option, the foam plug extends from the sash to the frame. Optionally, the engagement portion and spring member are integral and the engagement portion includes a deformable coating.

In another option, a method for making a window assembly includes, providing a frame and providing a sash disposed within the window frame. A spring member is coupled around the sash. At least one engagement portion is coupled to the spring member. The at least one engagement portion extends between the spring member and the window frame and the at least one engagement portion is slidably engaged against the frame.

Several options for the method follow. In one option, a second engagement portion is coupled to the spring member. In another option, the method includes coupling a foam plug between the at least one engagement portion and the second engagement portion. Optionally, the foam plug extends from the sash to the frame. In another option, coupling the engagement portion to the spring member includes forming a deformable foam membrane and the foam membrane includes at least one of the engagement portion and the spring member. In yet another option, openings are formed in the at least one engagement portion. In one option, screen material is coupled to the at least one engagement portion so the screen material covers the openings. The method includes, in another option, coupling the at least one spring member to a support panel. The support panel is coupled around the sash to couple the spring member around the sash, in yet another option. Optionally, the support panel includes a deformable projection and the deformable projection is disposed within a channel extending around the outer perimeter of the sash.

The screen assembly described herein provides an effective barrier against insects and the like, while allowing ventilation around the sash. The screen assembly is compact and does not require additional storage space when the sash is in a closed position. Additionally, when closed, the screen assembly is concealed between the sash and the frame. Thus, the screen assembly does not alter the aesthetics of the window. Moreover, in another option, the screen assembly is preinstalled in a window assembly as a single unit. Installation of the window assembly provides a ready to use window with a screen assembly. Further, coupling the screen assembly to the sash and slidably coupling the engagement portion to the frame reduces manufacturing and labor costs because affixing the screen assembly to the frame is unnecessary.

These and other embodiments, aspects, advantages, and features of the present invention will be set forth in part in the description which follows, and in part will become apparent to those skilled in the art by reference to the following description of the invention and referenced drawings or by practice of the invention. The aspects, advantages, and features of the invention are realized and attained by means of the instrumentalities, procedures, and combinations particularly pointed out in the appended claims and their equivalents.

DESCRIPTION OF THE EMBODIMENTS

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized and that structural changes may be made without departing from the scope of the present invention. Therefore, the following detailed description is not to be taken in a limiting sense, and the scope of the present invention is defined by the appended claims and their equivalents.

Figure 1:
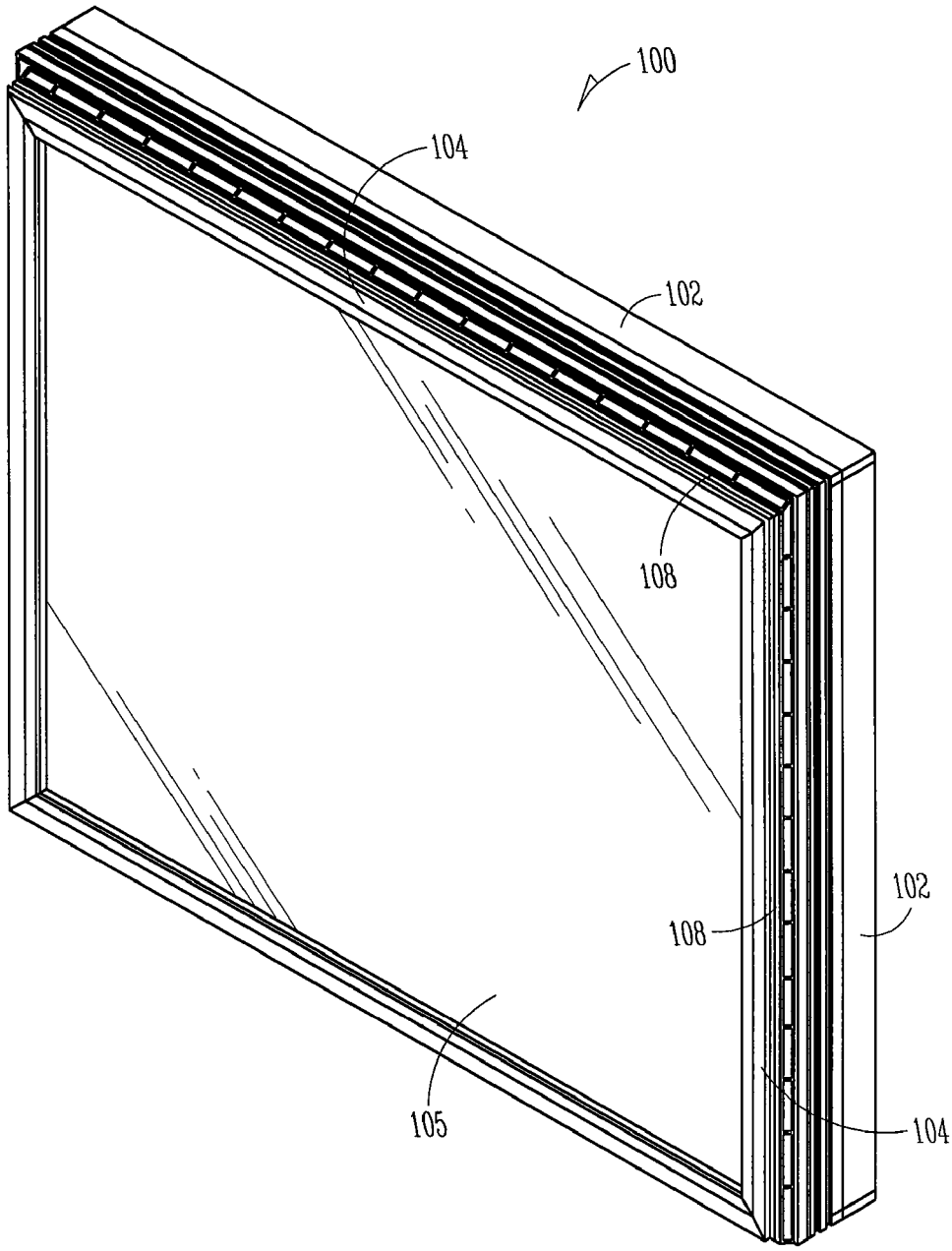
FIG. 1 is a perspective view of an example of a window assembly in an open position.

FIG. 1 is a perspective view illustrating one example of a window assembly 100 in an open position including at least one sash 104 and a frame 102. In one option, the sash 104 is dimensioned and configured to fit within the frame 102. In another option, the sash 104 is dimensioned and configured to project outwardly from the frame 102. The sash 104 projects from the frame 102, in one option, substantially horizontally with respect to the frame 102. In another option, the sash 104 is substantially horizontal relative to the frame 102 in the open position, a closed position (FIG. 2) and intermediate positions therebetween. The sash 104 is substantially parallel to a plane defined by the frame 102 in the open position, closed position or intermediate positions, in yet another option. As shown in FIG. 1, the sash 104 is in the open position and projected away from the frame 102. The frame 102 includes wood, in one option. In another option, the frame 102 includes, but is not limited to, aluminum, steel, and/or plastic. In yet another option, the frame 102 includes a composite construction (e.g., wood particles and a polymer). The sash 104 includes at least one glass pane 105, optionally.

In one option, the sash 104 is coupled to the frame 102 through drive mechanisms. The drive mechanisms are operable for projecting the sash 104 substantially horizontally with respect to the frame 102. One example of a drive mechanism is shown in Curtis et al., U.S. patent application Ser. No. 10/933,817 filed on Sep. 3, 2004, entitled "WINDOW DRIVE MECHANISM," which is assigned to the assignee of the present application and which is incorporated by reference herein in its entirety. In one option, the drive mechanisms project the sash 104 with respect to the frame 102 with a predominant horizontal component and a vertical component. As a result, the sash 104 is translatable with respect to the frame 102.

Figure 2:
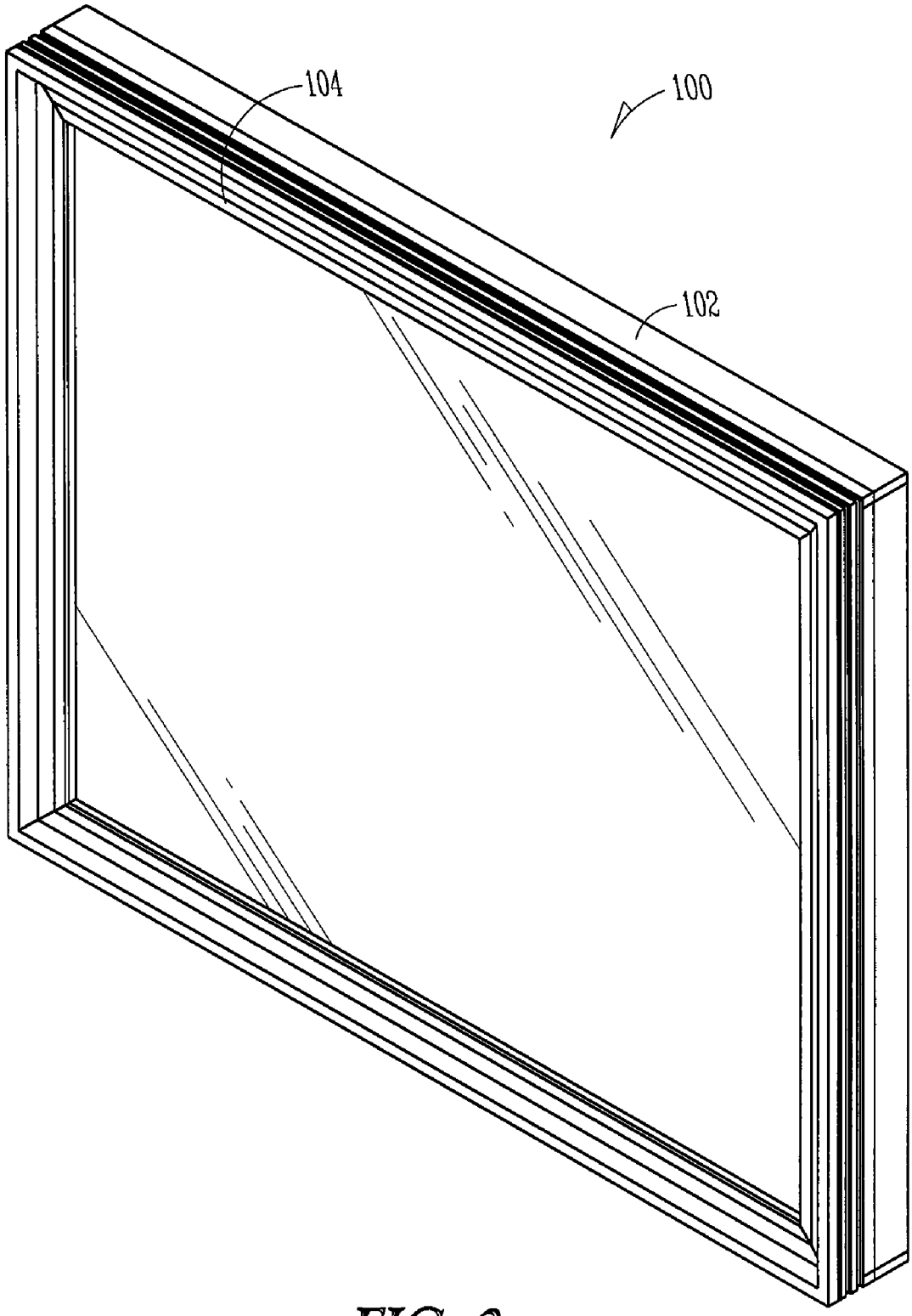
FIG. 2 is a perspective view of an example of a window assembly in a closed position.

FIG. 2 is a perspective view of the window assembly 100 in a closed position. The sash 104 is seated against the frame 102. In one option, the sash 104 tightly seals around the frame 102 and provides a substantially windproof and weatherproof barrier between the two sides of the window assembly 100. In another option, the sash 104 is disposed within the frame 102. The sash 104 is partially disposed within the frame 102, in yet another option. Optionally, as shown in FIG. 1, the sash 104 includes an outer perimeter 108. The outer perimeter 108 of the sash 104 engages against an inner perimeter of the frame 102 when the sash 104 is in the closed position (FIG. 2), in yet another option.

Figure 3A:
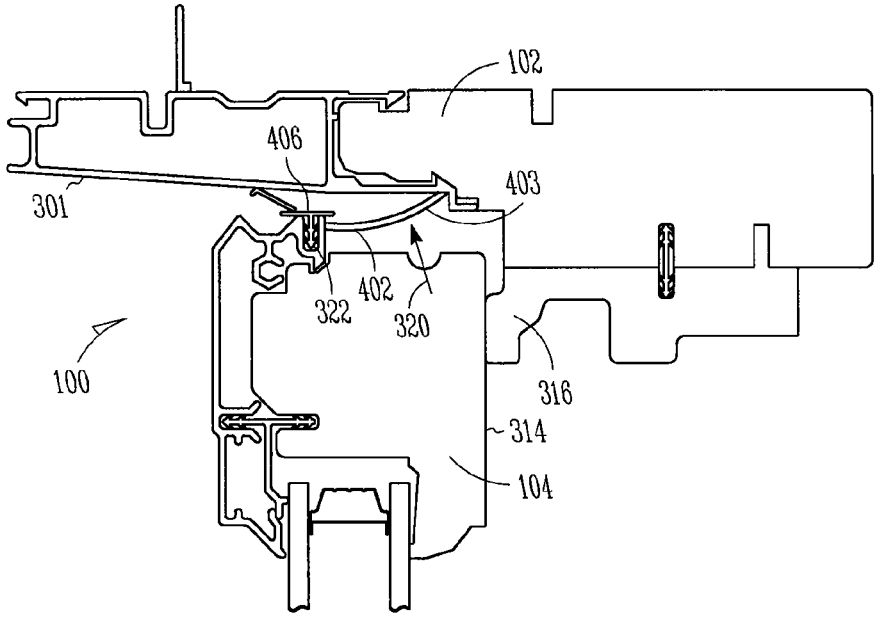
FIG. 3A is a sectional view of an example of a window assembly in a closed position.
Figure 3B:
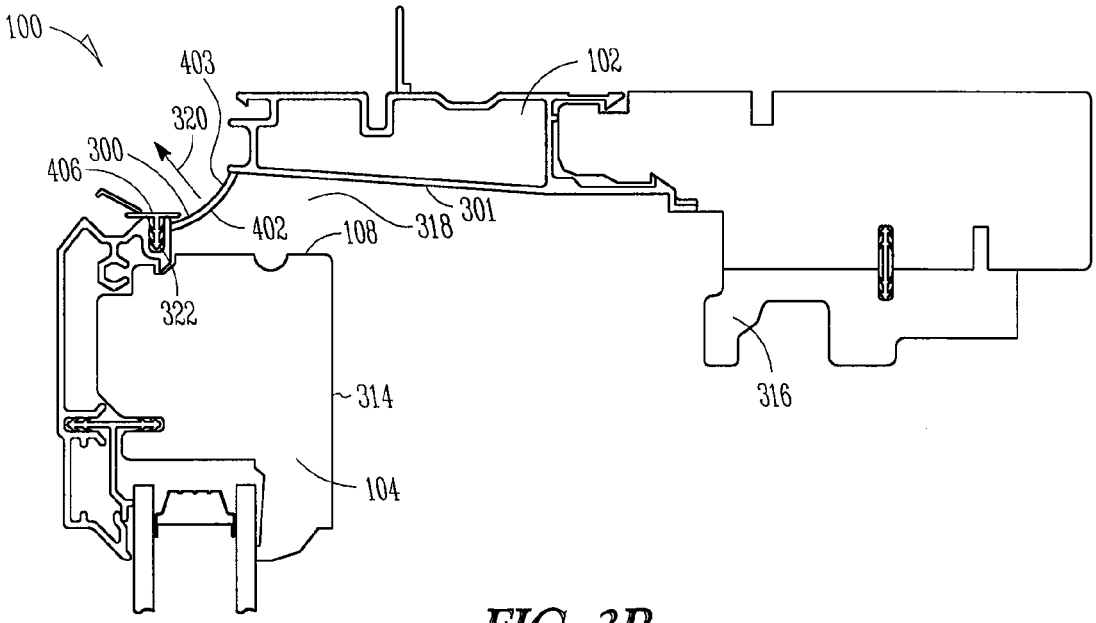
FIG. 3B is a sectional view of an example of the window assembly in an open position.

FIGS. 3A and 3B are sectional views illustrating one example of a screen assembly 300 in closed and open positions, respectively. The screen assembly 300 extends between the frame 102 and the sash 104 and facilitates ventilation therebetween while substantially preventing the ingress of insects or the like. In one option, a sash inner portion 314 and a frame inner portion 316 are spaced from one another in the open position shown in FIG. 3B. In the open position, a gap 318 is formed between the sash 104 and the frame 102 to allow ventilation between the outer face of the window assembly 100 and the inner face through the screen assembly 300. The screen assembly 300 separates the inner face and outer face of the window assembly 100 and allows for ventilation, in one option. In another option, the screen assembly 300 extends between the sash 104 and the frame 102 in the open position (FIG. 1), closed position (FIG. 2) and intermediate positions therebetween.

Figure 4:
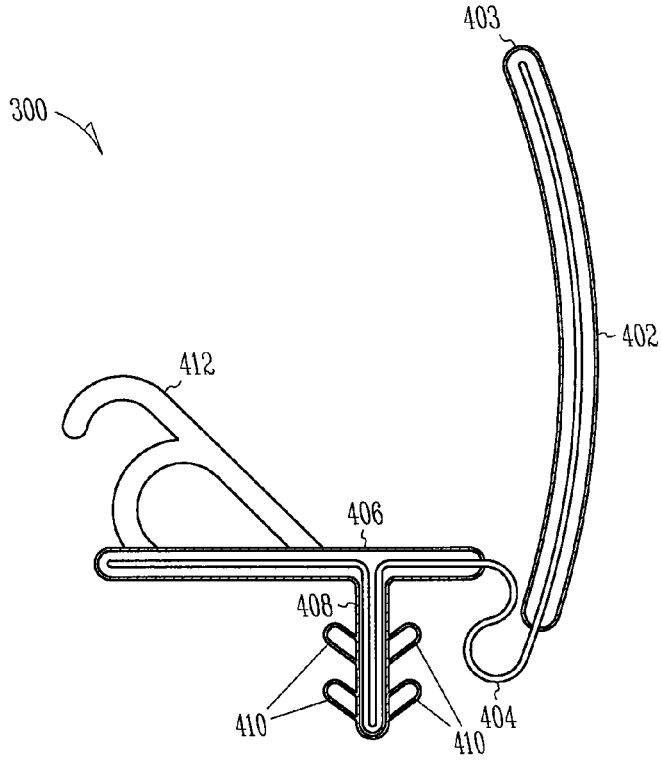
FIG. 4 is a sectional view of an example of a screen assembly.

FIG. 4 is a sectional view of one example of a screen assembly 300. In one option, the screen assembly 300 includes at least one engagement portion 402 engagable against the frame 102, shown in FIGS. 3A, 3B. Optionally, the engagement portion 402 extends substantially along the length of the inner perimeter 301 of the frame 102 so the screen assembly 300 substantially continuously extends between the sash 104 and the frame 102 (FIGS. 3A, 3B). In another option, the engagement portion 402 is constructed with a deformable material, for example, vulcanized rubber, steel, or the like. The engagement portion 402, optionally, is constructed with a core of metal (e.g. steel, aluminum, or the like) and coated with vulcanized rubber, foamed rubber, or the like.

Referring again to FIGS. 3A, 3B, in one option, the engagement portion 402 is slidably coupled to the frame 102. In an option, the engagement portion 402 slides over the inner perimeter 301 of the frame 102 and maintains constant engagement with the frame 102. In another option, the engagement portion 402 is sealed against the frame 102 substantially throughout translation of the sash 104. In still another option, the engagement portion 402 is slidably coupled to the sash 104. The engagement portion 402, optionally, is in slidable engagement along substantially the length of the outer perimeter 108 of the sash 104.

Figure 5:
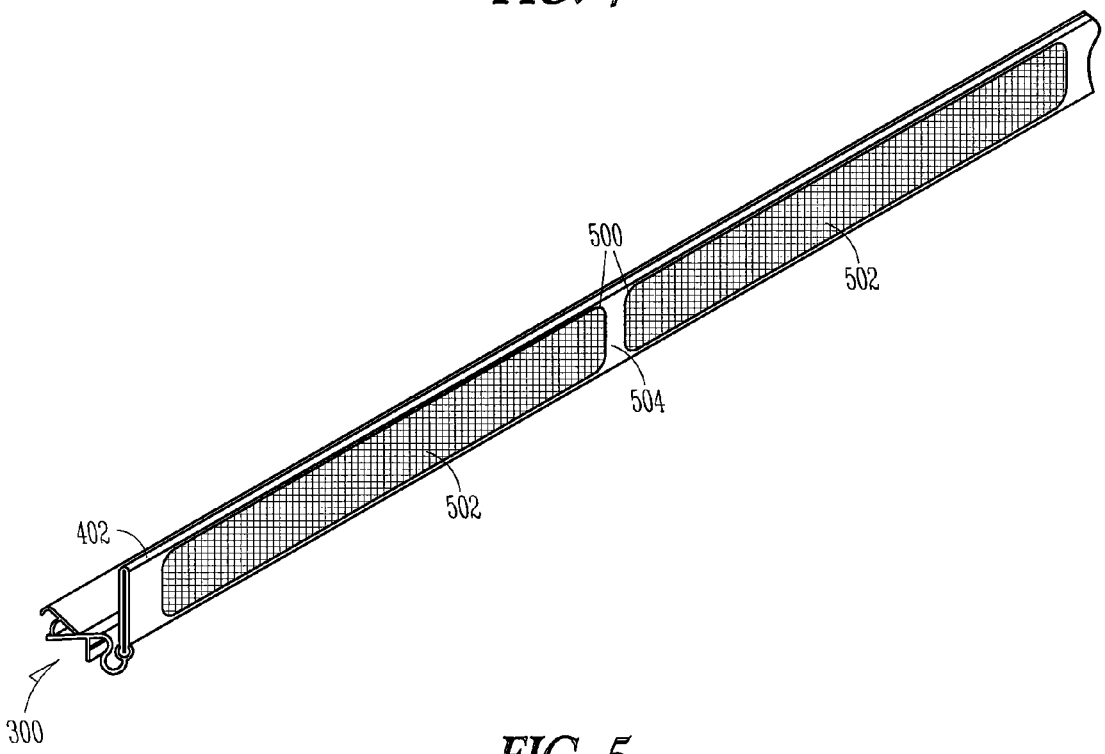
FIG. 5 is a perspective view of an example of an engagement portion.

FIG. 5 is a perspective view of the surface of one example of engagement portion 402. In one option, the engagement portion 402 includes openings 500. In another option, the openings 500 are large enough to allow air to pass from one side of the engagement portion 402 to the other side. The openings 500, in yet another option, are small enough to substantially prevent the ingress of insects or the like through the screen assembly 300. The openings 500 are gaps extending along the engagement portion 402, optionally. The openings, in one option, are filled with a screen material 502. In one option, the screen material 502 is interlaced (e.g. mesh). The interlaced screen material 502 allows for ventilation between the sash 104 and the frame 102, but substantially prevents the ingress of insects, or the like. The interlaced screen material 502 includes a mesh of small diameter wires, in another option. In yet another option, the interlaced screen 502 includes a mesh of fibers. Optionally, the openings 500 are filled with a film material having microopenings that allow passage of air but substantially prevent the ingress of insects. In another option, the screen material 502 is coupled to the engagement portion 402 with adhesive around the openings 500, overmolding the screen material 502 onto the engagement portion 402, folding panels of the engagement portion 402 over the screen material 502, or the like.

In another option, the openings 500 are interspersed along the engagement portion 402 so bridges 504 extend between the openings 500. The openings 500 and screen material 502 disposed therein provide less resiliency than the material of the engagement portion 402. The engagement portion 402, in one option, needs sufficient resiliency to maintain a tight slidable coupling with the frame 102. Bridges 504, optionally, provide sufficient resilience to the engagement portion 402 to maintain the engagement portion 402 in slidable engagement against the frame 102. The bridges 504 are made to include, but are not limited to, similar materials used in the engagement portion 402 (e.g., vulcanized rubber, polymers, steel, or the like)

Referring again to FIG. 4, a spring member 404 is coupled to the engagement portion 402. In one option, the spring member 404 and engagement portion 402 are integrally formed. In another option, the engagement portion 402 is coupled to the spring member 404 with an adhesive, an interference fit within a clip, or the like. The engagement portion 402, in yet another option, is bendable around the spring member 404. The spring member 404 applies a restoring force to the engagement portion 402. The restoring force, in one option, is a torsional force applied to the engagement portion 402. The restoring force is shown in FIGS. 3A, 3B by the directional arrows 320. In one option, the restoring force applied by the spring member 404 to the engagement portion 402 forces the engagement portion 402 into contact with the inner perimeter 301 of the frame 102. Optionally, the spring member 404 seals the engagement portion 402 to the inner perimeter 301 and forces the engagement portion 402 to maintain contact with the frame 102 substantially throughout the range of motion of the sash 104. The engagement portion 402 includes, in another option, a curved shape that curls the engagement portion 402 toward the inner perimeter 301 and helps maintain contact with the frame 102. In yet another option, the engagement portion 402 extends between the sash 104 and the frame 102 (See FIGS. 3A, 3B) in the closed position, the open position, and intermediate positions therebetween. As described above, in one option, the engagement portion 402 extends substantially along the length of the inner perimeter of the frame 102 so the screen assembly 300 substantially continuously extends between the sash 104 and frame 102. In another option, the spring member 404 has a modified "S" shape, as shown in FIG. 4. The spring member 404 is a leaf spring, in yet another option, having a substantially planar geometry when the engagement portion 402 is not engaged against the frame 102.

Figure 6A:
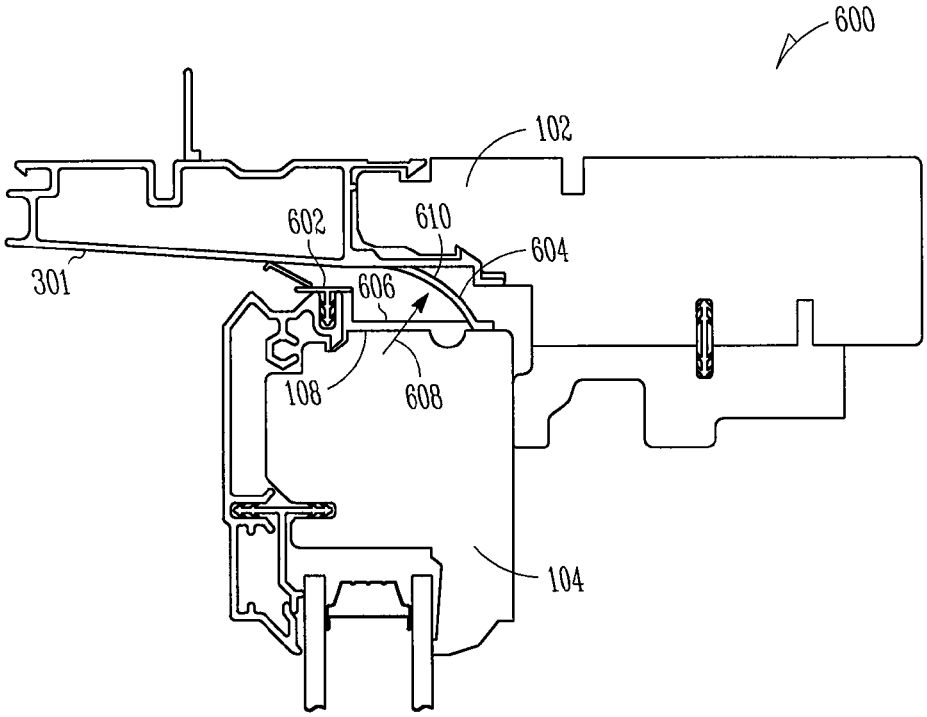
FIG. 6A is a sectional view of another example of a window assembly in a closed position.
Figure 6B:
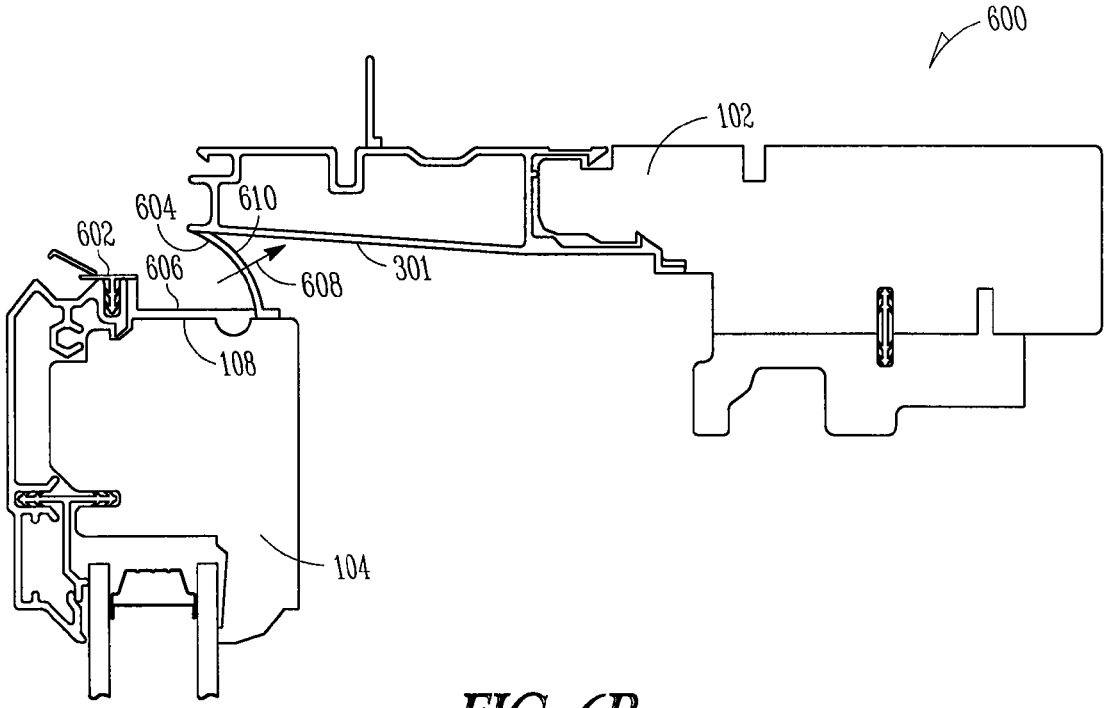
FIG. 6B is a sectional view of another example of the window assembly in an open position.
Figure 7:
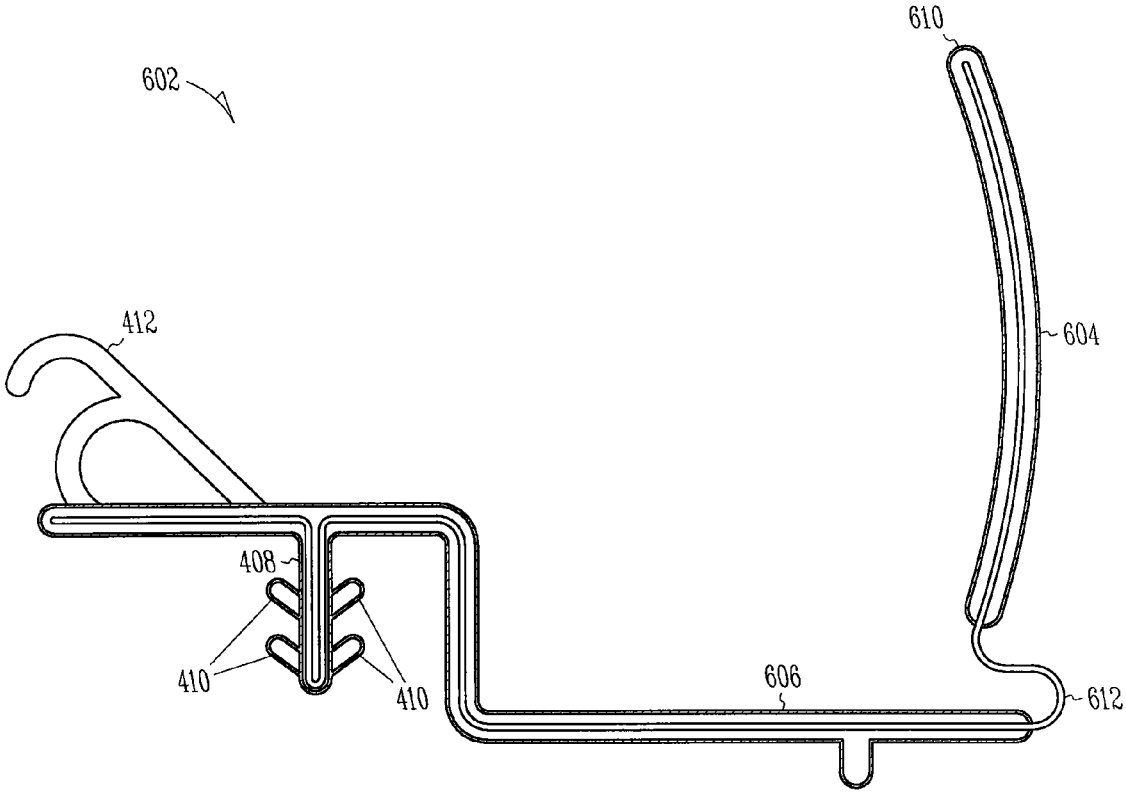
FIG. 7 is a sectional view of another example of a screen assembly.

In one option, shown in FIGS. 3A, 3B, the spring member 404 is coupled to the outer perimeter 108 of the sash 104. Optionally, the spring member 404 extends substantially along the length of the outer perimeter 108 of the sash 104. In another option, the spring member 404 is coupled to a support panel 406. The support panel 406 is coupled to the sash 104. In one option, the support panel 406 extends substantially along the length of the outer perimeter 108 of the sash 104. The engagement portion 402, spring member 404 and support panel 406 (FIG. 4) are integrally formed, in another option. Optionally, the support panel 406 includes a steel base and a deformable outer coating (e.g. plastic). In yet another option, the engagement portion 402 is bent so a free end 403 of the engagement portion points substantially toward the frame inner portion 316. As shown in FIGS. 6A, 6B and 7 herein, the engagement portion 402 is bent back along the inner perimeter 108 of the sash 104 in another option. As a result, the engagement portion 402 is folded back along the support panel 406. The spring member 404 is coupled to the frame 102, and the engagement portion is slidably coupled to the sash 104, in one option. Optionally, the spring member 404 is coupled to the support panel 406, and the support panel 406 couples the spring member 404 and engagement portion to the frame 102.

In one option, shown in FIG. 4, the support panel 406 includes at least one projection 408. The projection 408 includes deformable barbs 410, in another option. The deformable barbs 410 include, but are not limited to, vinyl, rubber, or the like. In one option, the projection 408 and barbs 410 are dimensioned and configured for insertion into a channel 322 (See FIGS. 3A, 3B) in the sash 104. In another option, the channel 322 extends substantially around the outer perimeter 108 of the sash 104. The barbs 410 deform when inserted within the channel 322 and provide an interference fit between the projection 408 and the sash 104. In one option, the projection 408 secures the screen assembly 300 against the sash 104.

In another option, weather-stripping 412 is disposed along the support panel 406. In an option, as the sash 104 is translated with respect to the frame 102, the weather-stripping 412 moves with the sash 104. In another option, the weather-stripping 412 includes a deformable material (e.g. reticulated foam, foamed rubber or vinyl). In yet another option, the weather-stripping 412 is deformed when engaged against the inner perimeter 301 of the frame member 102. A plastic film is disposed along the outer surface of the weather-stripping 412, optionally, to allow for slidable coupling between the weather-stripping 412 and the frame 102 when the sash 104 is in the closed position. In one option, in the closed position (FIGS. 2 and 3A), the weather-stripping 412 and the engagement portion 402 complement one another to provide a tight composite seal between the sash 104 and the frame 102. In another option, the weather-stripping 412 disengages from the frame 102 when the sash 104 is projected outward and into the open position (FIGS. 1 and 3B). Optionally, in the open position, ventilation occurs between the sash 104 and the frame 102 when the weather-stripping 412 is not engaged to the frame 102.

FIGS. 6A and 6B are sectional views of a window assembly 600 in closed and open positions, respectively. In some aspects, the window assembly 600 is similar to the window assembly 100. In one option, window assembly 600 includes screen assembly 602. Screen assembly 602 includes engagement portion 604. Engagement portion 604 is folded back along the outer perimeter 108 of the sash 104. In another option, the engagement portion 604 is bent along the support panel 606. The engagement portion 604 is bent over the support panel 606 when the sash 104 is translated between the closed and open positions (FIGS. 6A and 6B respectively), in another option.

FIG. 7 is a sectional view of the screen assembly 602. The screen assembly 602 includes support panel 606. In one option, the support panel 606 has a discontinuous plateaued cross-section dimensioned and configured to couple with a corresponding outer perimeter 108 of the sash 104. Relative to support panel 406, support panel 606, in another option, has an increased length between the projection 408 and the coupling between the engagement portion 604 and the support panel 606. As shown in FIGS. 6A, 6B, the increased length positions the free end 610 of the engagement portion 604 against the inner perimeter 301 of the frame 102. As a result, in the closed position (FIG. 6A), the open position (6B) and intermediate positions, the engagement portion 604 is in constant slidable contact with the frame 102.

The screen assembly 602 includes a spring member 612. In one option, the spring member 612 is coupled to the engagement portion 604 and the support panel 606. Optionally, the spring member 612 is integral with the engagement portion 604 and/or the support panel 606. The engagement portion 604, in an option, is bendable around the spring member 612. In another option, the spring member 612 provides a restoring force to the engagement portion 604. The restoring force, in one option, is a torsional force. The restoring force forces the engagement portion 604 into engagement with the frame 104. In one option, the restoring force drives the engagement portion 604 in a direction corresponding to the arrows 608. In another option, the spring member 612 maintains a slidable coupling between the engagement portion 604 and the inner perimeter 301 of the frame 102. In yet another option, the screen assembly 602 includes a projection 408 and barbs 410 similar to screen assembly 300. The screen assembly 602 includes weather-stripping 412 coupled to the support panel 606, optionally. In yet another option, openings for ventilation are formed in the engagement portion 604 in a similar manner to the engagement portion 402 of the screen assembly 300.

Figure 8:
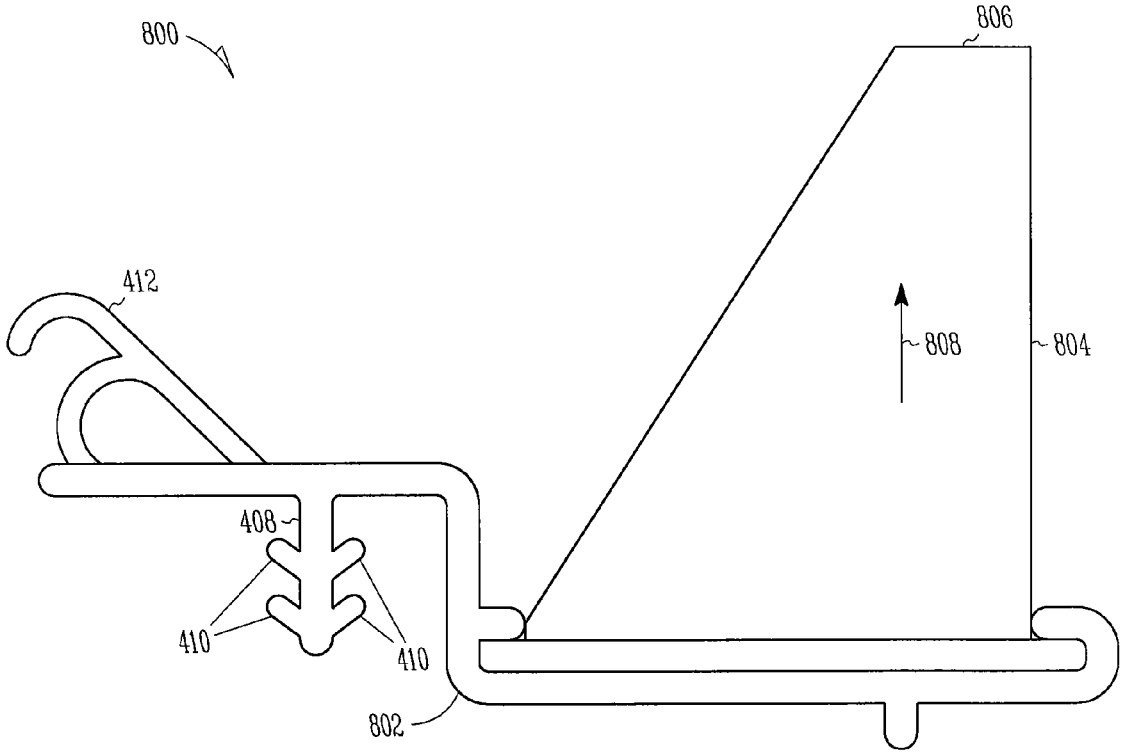
FIG. 8 is a sectional view of yet another example of a screen assembly.

FIG. 8 is another example of a screen assembly 800. Screen assembly 800 includes a support panel 802. In one option, a projection 408 having barbs 410 is coupled to the support panel 802. The projection 408 and barbs 410 are dimensioned and configured, in another option, to interference fit within a channel 322 of the sash 104. In yet another option, the projection 408 retains the screen assembly 800 along the sash 104. Weather-stripping 412 is disposed along the support panel 802, optionally, as described above in regard to screen assembly 300, 502.

The screen assembly 800 includes a deformable membrane, such as a foam membrane 804, coupled to the support panel 802. In one option, the deformable membrane includes, but is not limited to rubber, vinyl, gel material within a sleeve or the like. In another option, the foam membrane 804 includes an engagement portion 806. The foam membrane 804 extends from the support panel 802 so the engagement portion 806 is engaged to the inner perimeter 301 of the frame 102, in yet another option. Optionally, the foam membrane 804 is a spring member that is compressible and extends between the sash 104 and the frame 102. In another option, the foam membrane 804 is substantially uncompressed when the sash 104 is translated to an open position. Compression of the foam membrane 804, in one option, for instance with translation of the sash 104 to a closed position within the frame 102, creates an expansive restoring force. In another option, the restoring force maintains the engagement portion 806 in engagement against the inner perimeter 301 of the frame 102. Optionally, when compressed, the restoring force of the foam membrane 804 points away from the support panel 802 substantially in the direction of arrow 808. In still another option, during movement of the sash 104, the restoring force maintains the engagement portion 806 in contact with the frame 102. The foam membrane 804, in one option, includes cavities disposed within the material of the membrane 804 and formed during manufacture of the foam membrane 804. The cavities allow compression of the foam membrane 804. Optionally, the material of the foam membrane 804 provides the restoring force when the membrane 804 is compressed.

In yet another option, the foam membrane 804 extends substantially along the length of the inner perimeter 301 of the frame 102 so the screen assembly 800 continuously extends between the sash 104 and the frame 102. In another option, the screen assembly 800 is retained along the inner perimeter 301 of the frame 102 and extends to the sash 104. The foam membrane 804 extends from the frame 102 and is slidably coupled to the outer perimeter 108 of the sash 104, optionally.

In another option, the engagement portion 806 is in slidable contact with the frame 102. The foam membrane 804 includes, but is not limited to, reticulated foam, foamed rubber or the like, in one option. In another option, the engagement portion 806 includes a film or coating that has a lower coefficient of friction than the foam membrane 804. The film or coating enhances sliding movement between the engagement portion 806 and the frame 102. In yet another option, the openings are formed in the foam membrane 804 to allow ventilation between the outer surface and inner surface of a window assembly. Optionally, the openings of the foam membrane 804 are cavities present in the foamed material (e.g. reticulation). In one option, the openings are small enough to substantially prevent the ingress of insects and the like through the screen assembly 800.

Figure 9:
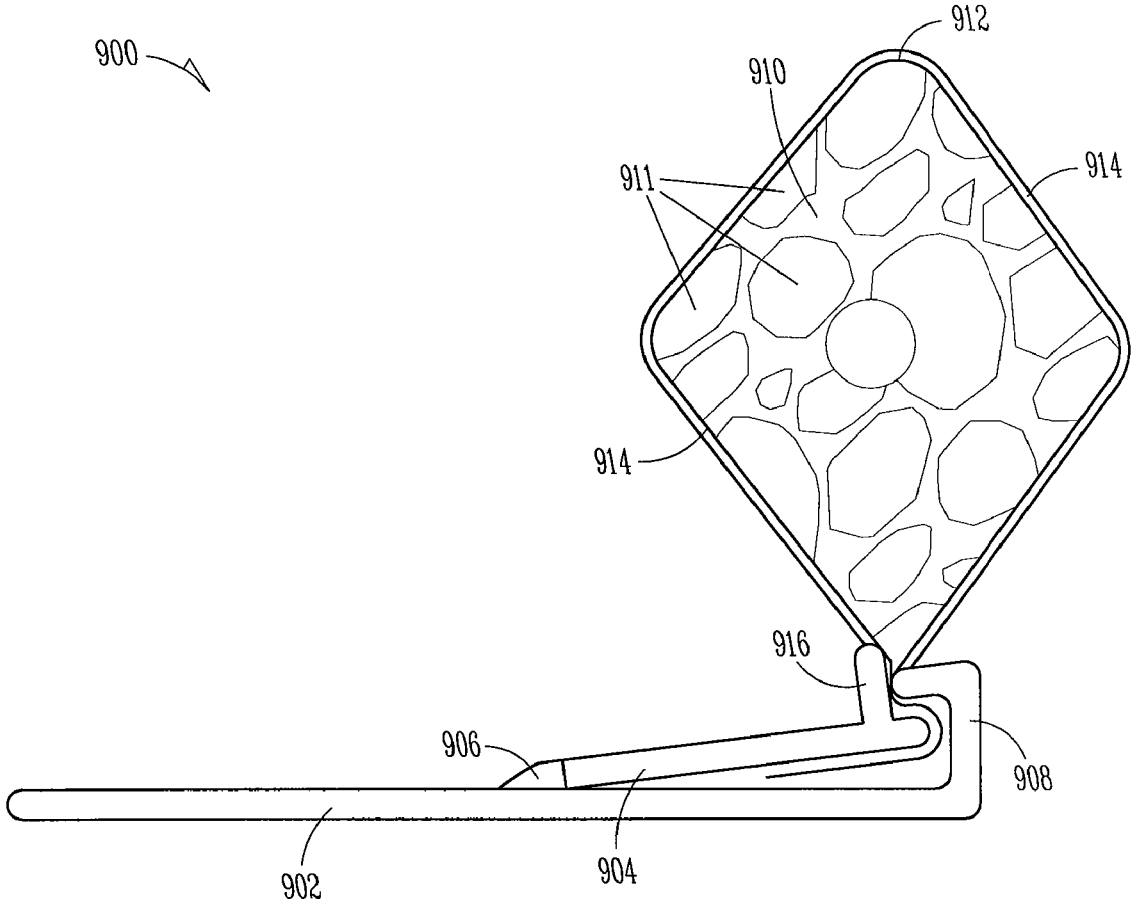
FIG. 9 is a sectional view of still another example of a screen assembly.

FIG. 9 shows yet another example of a screen assembly 900. The screen assembly 900 includes a support panel 902. In one option, a retaining member 904 is rotatably coupled to the support panel 902. The support panel 902 and the retaining member 904 include, but are not limited to, polyvinyl chloride, rigid polyvinyl chloride, chlorinated polyvinyl chloride, polypropylene or the like. The retaining member 904 is rotatably coupled to the support panel 902, in another option with a hinge 906. In yet another option, the hinge 906, is constructed with a deformable material that allows the retaining member 904 to rotate. The hinge 906 is constructed with, but not limited to, flexible polyvinyl chloride, urethane or the like. The hinge 906, optionally includes SANTOPRENE® a registered trademark of the Monsanto Company. The hinge 906, retaining member 904 and support panel 902 are coextruded in one option.

The retaining member 904 is sized and shaped to engage against a hook 908 extending from the support panel 902. Engagement of the retaining member 904 to the hook 908 with sufficient force deforms the hook 908 and/or the retaining member 904 so the retaining member 904 snap fits beneath the hook 908. In one option, the hook 908 is bent backward on itself (e.g. has an angular measure of 90 degrees or less) toward the support panel 902 to enhance the snap fit of the retaining member 904 with the hook 908. The hook 908 operates to secure the retaining member 904 along the support panel 902. The support panel 902 includes, in another option, an adhesive or the like (e.g. adhesive double sided tape) to couple the screen assembly 900 to the sash 104 (FIG. 1). Optionally, the support panel 902 is coupled to the sash 104 with a projection and barbs (described above), nails, screws or the like.

The screen assembly 900 includes a deformable membrane, such as a foam membrane 910 coupled to the support panel 902. In one option, the foam membrane 910 includes an engagement portion 912. The foam membrane 910 extends from the support panel 902 so the engagement portion 912 is engaged to the inner perimeter 301 of the frame 102 (FIG. 1), in another option. Optionally, the foam membrane 910 is a spring member that is compressible and extends between the sash 104 and the frame 102 (FIG. 1). Compression of the foam membrane 910, in one option, creates an expansive restoring force (e.g., with translation of the sash 104 to a closed position within the frame 102). In another option, the restoring force maintains the engagement portion 912 in engagement against the inner perimeter 301 (FIG. 3) of the frame 102. Optionally, during movement of the sash 104, the restoring force maintains the engagement portion 912 in slidable contact with the frame 102.

In one option, the foam membrane 910 includes cavities 911 disposed within the material of the membrane 910 and formed during manufacture of the foam membrane 910. The cavities 911 allow compression of the foam membrane 910. The material of the foam membrane 804 provides the restoring force when the membrane 804 is compressed. In another option, the cavities 911 are reticulated and extend through the foam membrane 910 to allow ventilation through the foam membrane 910. Optionally, the cavities 911 are small enough to substantially prevent the ingress of insects and the like through the screen assembly 900. The foam membrane 910 includes, but is not limited to, foamed rubber, filter fiber, or the like, in one option. In another option, the foam membrane 910 includes POLYDAMP® a registered trademark of Polymer Technologies, Inc. The foam membrane 910, in one option, includes a diamond shape. The narrower portions of the foam membrane 910 adjacent to the support panel 902 and the engagement portion 912 correspondingly have cavities 911 extending through less of the foam membrane 910 to enhance ventilation through the foam membrane. The thicker portion of the foam membrane 910 provides sufficient structure for the foam membrane 910 to extend between the frame 102 and the sash 104 (FIG. 1) in the open, closed and intermediate positions.

In another option, the foam membrane 910 extends substantially along the length of the inner perimeter 301 (FIG. 3) of the frame 102 so the screen assembly 900 continuously extends between the sash 104 and the frame 102 (FIG. 1). In another option, the screen assembly 900 is retained along the inner perimeter 301 (FIG. 3) of the frame 102 and extends to the sash 104. The foam membrane 910 extends from the frame 102 and is slidably coupled to the outer perimeter 108 of the sash 104, optionally.

In yet another option, at least a portion of the engagement portion 912 is surrounded by a jacket 914. The jacket 914 is deformable and sized and shaped to deform with compression of the foam membrane 910. The jacket 914 is engaged to the inner perimeter 301 of the frame 102, optionally. In one option, the jacket 914 is constructed with a screen mesh including apertures to allow ventilation through the jacket 914. In another option, the jacket 914 includes apertures sized and shaped to prevent the ingress of insects, contaminants or the like. The foam membrane cavities 911, optionally, are larger than the apertures to enhance ventilation through the membrane 910 while the jacket 914 screen mesh substantially prevents the ingress of insects, contaminants, and the like into the cavities 911 of the foam membrane 910. In one option, the apertures of the jacket 914 are smaller than the cavities 911 of the foam membrane 910 to keep contaminants out of the foam membrane 910 and thereby facilitate cleaning of the screen assembly 900 by cleaning only the jacket 914. The jacket 914, in one option, includes, but is not limited to, vinyl coated fiberglass strands, nanofibers or the like.

To assemble the screen assembly 900, in one option, the jacket 914 is placed around the foam membrane 910. The jacket 914, in another option, has an inner perimeter larger than the outer perimeter of the foam membrane 910 so the jacket 914 loosely fits around the foam membrane 910. The jacket 914 is positioned adjacent to the hook 908 and the retaining member 904 is engaged against the hook 908. The retaining member 904 deforms the hook 908 and snap fits underneath the hook 908. The retaining member 904 and the hook 908 grasp the jacket 914 and secure the jacket 914 to the support panel 902. In yet another option, the jacket 914 snugly fits around the foam membrane 910, and the jacket 914 and at least a portion of the foam membrane 910 are grasped by the retaining member 904 and the hook 908.

In another option, the retaining member 904 includes a flange 916 substantially adjacent to the hook 908. The flange 916 engages against the jacket 914 and the foam membrane 910 to push the foam membrane 910 into a position substantially orthogonal relative to the support panel 902. The flange 916 and the grasping of the jacket 914 by to the hook 908 and the retaining member 904 optionally cooperate to position the foam membrane 910 to engage with the inner perimeter 301 (FIG. 3) of the frame 102 (FIG. 1) throughout the range of movement of the sash 104 relative to the frame 102.

Figure 10A:
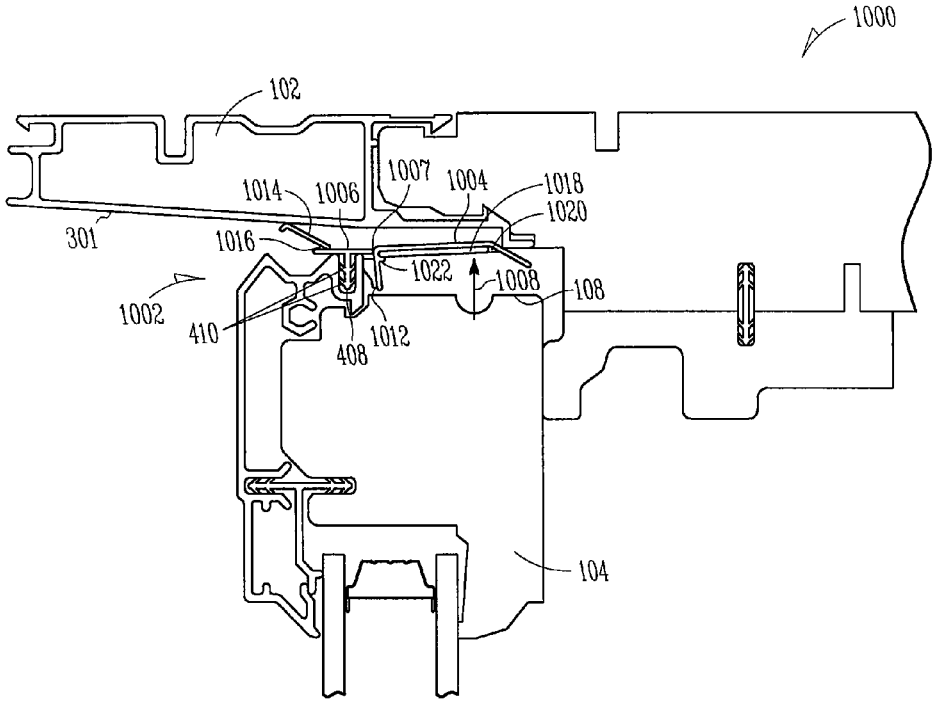
FIG. 10A is a sectional view of yet another example of a window assembly in a closed position.
Figure 10B:
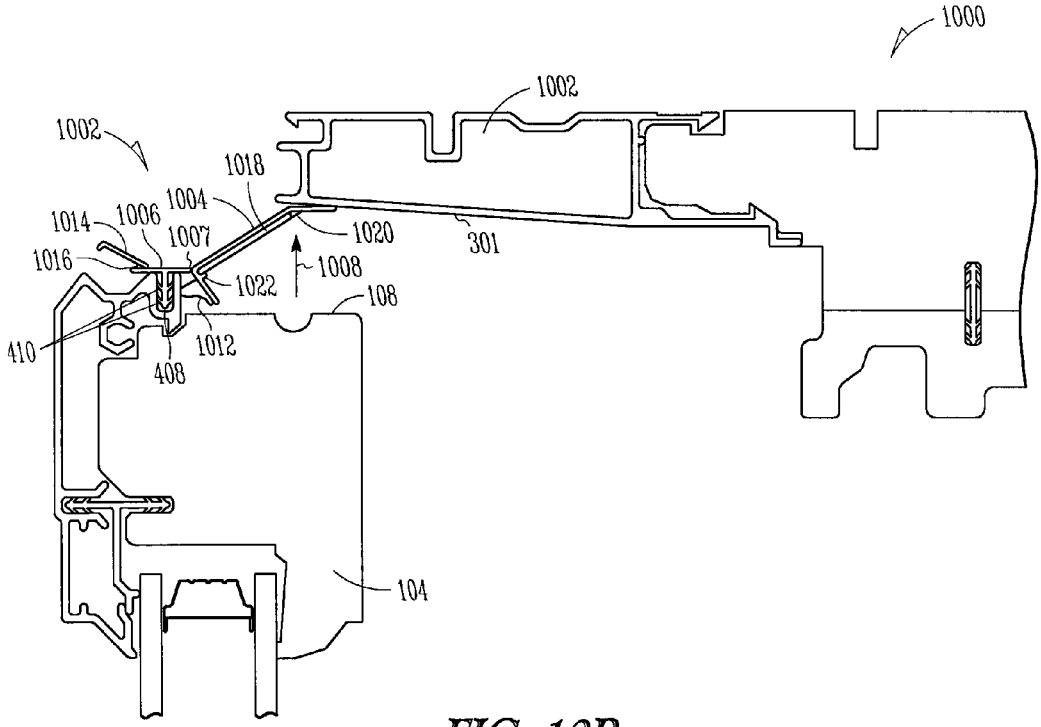
FIG. 10B is a sectional view of yet another example of the window assembly in an open position.

FIGS. 10A and 10B are sectional views of a window assembly 1000 in closed and open positions, respectively. In some aspects, the window assembly 1000 is similar to the window assemblies 100, 600. In one option, window assembly 1000 includes screen assembly 1002. Screen assembly 1002 includes engagement portion 1004. Engagement portion 1004 is folded back along the outer perimeter 108 of the sash 104. The engagement portion 1004 is bent over the sash 104 when the sash 104 is translated between the closed and open positions (FIGS. 10A and 10B, respectively), in another option. The engagement portion 1004 is sized and shaped to constantly engage against the frame 102. In one option, the engagement portion 1004 is in constant slidable contact with the frame 102 during translation of the sash 108 between the open position (FIG. 10B), the closed position (FIG. 10A) and intermediate positions.

As shown in FIGS. 10A, 10B, the screen assembly 1002 includes support panel 1006. The engagement portion 1004 is coupled to the support panel 1006 with a hinge 1007, for instance, a "living" hinge. In one option, the hinge 1007 includes a polymer, metal or the like. In one example, the hinge 1007 includes vinyl. The hinge 1007 extends between the support panel 1006 and the engagement portion 1004 and facilitates rotation of the engagement portion 1004 around the support panel 1006. Optionally, the hinge 1007 provides a restoring force sufficient to move the engagement portion 1004 toward the frame 102.

In another option, the support panel 1006 includes a projection 408 sized and shaped to fit within a channel extending along the sash 104. The projection 408 includes, optionally, barbs 410 that engage against the surfaces defining the channel to create an interference fit between the screen assembly 1002 and the sash 104. In yet another option, the screen assembly 1002 is coupled to the sash 104 with, but not limited to, adhesives, tacks, screws, staples or the like.

The screen assembly 1002 includes a spring member 1012. In one option, the spring member 1012 extends between the sash 104 and the engagement portion 1004. In one example, the spring member 1012 is coupled to the sash 104 and the engagement portion 1004. In another option, the spring member 1012 includes a deformable membrane such as a foam membrane (e.g., a reticulated foam). Optionally, the deformable membrane includes, but is not limited to foamed rubber, filter fiber, vinyl, gel material within a sleeve or the like. In another option, the deformable membrane includes POLY-DAMP® a registered trademark of Polymer Technologies, Inc.

The spring member 1012 provides a restoring force to the engagement portion 1004. The restoring force, in one option, is a torsional force created by compression and expansion of the deformable membrane of the spring member 1012. The spring member 1012 is sized and shaped to experience compression when the sash 104 is in an open position, closed position or intermediate positions. The spring member 1012 is biased to expand when compressed, and the expansion of the spring member 1012 provides the restoring force. The spring member 1012 continues to supply the restoring force to the engaging portion 1004 while the sash 104 is in any of these positions. The restoring force drives the engagement portion 1004 toward the frame 102 in a direction corresponding to the arrows 1008 (FIGS. 10A, B). The engagement portion 1004 is continuously engaged against the frame 102 because of the restoring force provided by the spring member 1012. In another option, the spring member 1012 maintains a slidable coupling between the engagement portion 1004 and the inner perimeter 301 of the frame 102.

Referring to FIGS. 10A, B, the screen assembly 1002 optionally includes weather-stripping 1014. The weather-stripping 1014 extends along the support panel 1006 and is coupled to the support panel with a hinge 1016, in one option. The hinge 1016, in another option, includes a "living" hinge extending between the weather-stripping 1014 and the support panel 1006. The hinge 1016 includes, but is not limited to, metal, polymers or the like. The hinge 1016 provides sufficient restoring force to the weather-stripping 1014 to bias the weather-stripping 1014 toward the inner perimeter 301 of the frame 102. As shown in FIG. 10A, when the sash 104 is in the closed position the weather-stripping 1014 is engaged against the frame 102. The weather-stripping 1014 is slidably engaged to the frame 102 from the closed position through an intermediate position. The weather-stripping 1014 disengages from the frame 102 as the sash 104 is further moved toward the open position, as shown in FIG. 10B. Optionally, the weather-stripping 1014 is a supplementary weather-stripping that cooperates with additional weather-stripping that extends between the frame 102 and the sash 104 when the sash 104 is in the closed position. In one option, the additional weather stripping includes a gasket, foam membrane or the like extending between the sash 104 and the frame 102.

In another option, the screen assembly 1002 includes openings for ventilation formed in the engagement portion 1004 in a similar manner to the engagement portion 402 of the screen assembly 300 (See FIG. 5). Optionally, a mesh material similar to mesh material 502 (FIG. 5) fills the openings to allow for ventilation around the sash 104 while preventing the ingress of insects or the like. The mesh material is coupled to the engagement portion 1004 with adhesives, overmolding, mechanical fasteners or the like.

As shown in FIGS. 10A, B, the screen assembly 1002 includes a screen panel 1018, in one option, sized and shaped to extend along at least a portion of the engagement portion 1004. The engagement portion 1004 includes openings corresponding to the openings in the engagement portion 1004. Similar to the engagement portion 402 shown in FIG. 5, the mesh material of screen assembly 1002 is optionally placed between the engagement portion 1004 and the screen panel 1018 and retained therebetween to fill the openings. The screen panel 1018 is coupled to the engagement portion 1004, in another option, with a hinge 1020, such as a "living" hinge or the like. The hinge 1020 allows the screen panel 1018 to rotate around the engagement portion 1004. The engagement portion 1004 includes at least one flange 1022 sized and shaped to retain the screen panel 1018 against the engagement portion 1004. In yet another option, the screen panel 1018 is rotated around the engagement portion 1004 using the hinge 1020. The mesh material is between the engagement portion 1004 and the screen panel 1018. The screen panel 1018 engages against the flange 1022 and snaps behind the flange 1022 and is retained against the engagement portion 1004 by cooperation of the flange 1022 and the hinge 1020.

Figure 11:
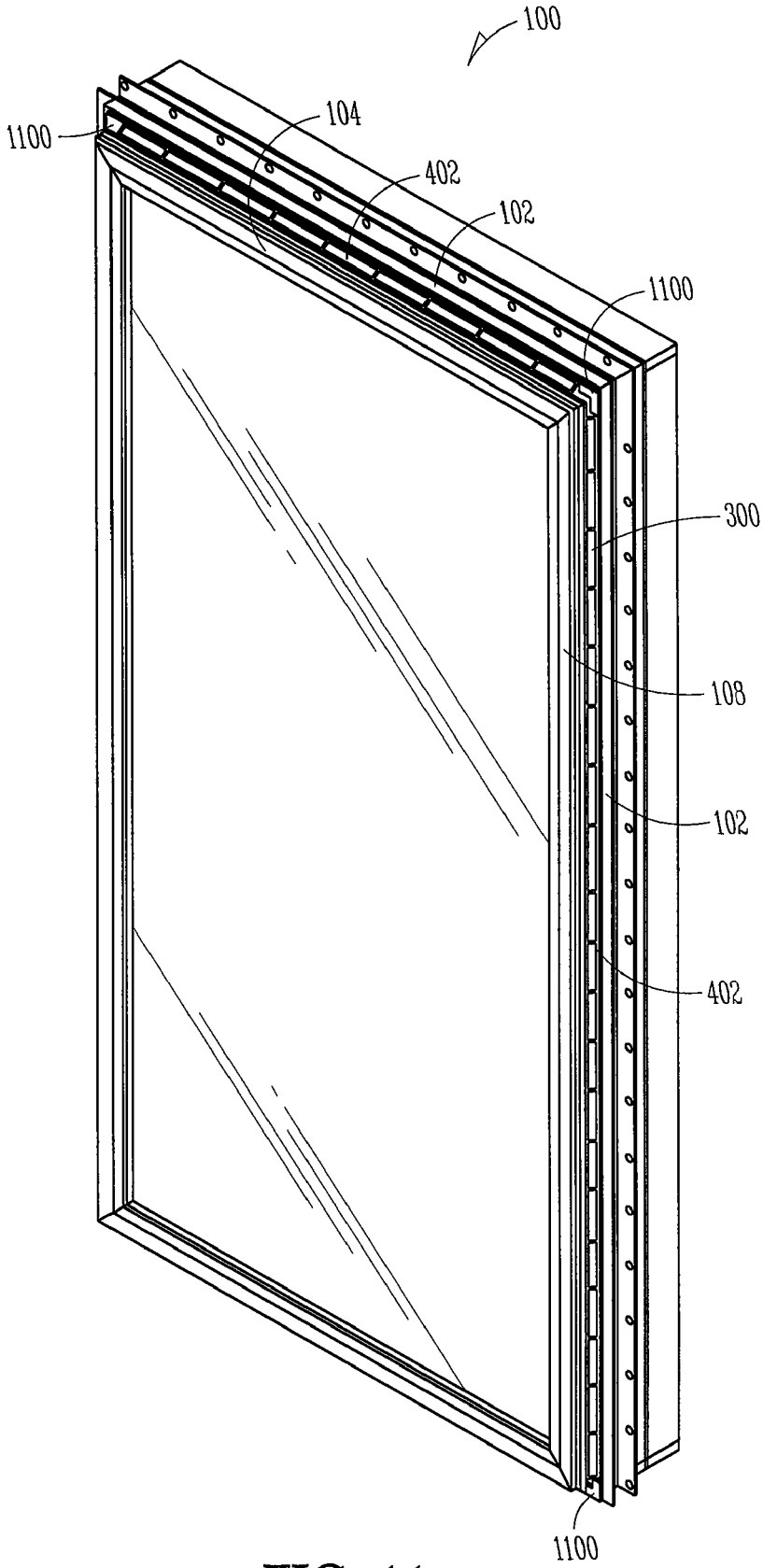
FIG. 11 Is a perspective view of a window assembly in the open position.

FIG. 11 shows the window assembly 100 including screen assembly 300. The screen assembly 300, is coupled to the outer perimeter 108 of the sash 104. In one option, the screen assembly 300 extends substantially around the outer perimeter 108. The screen assembly 300 extends to the corners of the sash 104, in another option. Optionally, the screen assembly 300 includes multiple engagement portions 402 each extending to the corners of the sash 104. In one option, foam plugs 1100 are coupled to the ends of the engagement portions 402. In another option, the foam plugs 1100 extend between the engagement portions 402 and between the sash 104 and frame 102. The foam plugs 1100 are coupled to the sash 104 and slidably coupled to the frame 102, in still another option. Optionally, the foam plugs 1100 are coupled to the sash with an adhesive, deformable barb, or the like. In one option, the engagement portions 402 extend from the sash 104 and are slidably coupled to the frame 102. As a result, a continuous screen is provided around the sash 104 and between the sash 104 and the frame 102 with the engagement portions 402 and foam plugs 1100.

In operation, in one option, translation of the sash 104 with respect to the frame 102 out of a closed position (FIGS. 3A, 6A) moves the sash 104 out of engagement with the frame 102 and into an open position (FIGS. 3B, 6B). The engagement portion 402 maintains a tight seal against the inner perimeter of the frame 102, in one option. In another option, the spring member 404 applies a restoring force (e.g. a torsional force) to the engagement portion 402 that maintains the engagement portion 402 in contact with the frame 102, providing a tight seal therebetween. In yet another option, the spring member 404 maintains a slidable coupling between the engagement portion 402 and the frame 102. The spring member 404 continues to engage the engagement portion 402 to the frame 102 substantially throughout the range of motion of the sash 104. In one option, the foam plugs 1100 (FIG. 11) extending between the engagement portions 402 move with the engagement portions 402. In another option, the foam plugs 1100 are compressed between the sash 104 and frame 102 and experience an expansive restoring force that maintains engagement of the foam plugs 1100 to the frame 102. As a result, the foam plugs 1100 slidably engage the frame 102 and maintain a tight seal thereto. Once in the open position, in one option, openings 500 (FIG. 5) in engagement portion 402 allow ventilation between the inside and outside of the window assembly 100. Optionally, the openings 500 include a mesh material 502 that allows for ventilation but substantially prevents the ingress of insects, dirt, leaves or the like.

Conversely, the operation described above may be repeated in reverse order to move the sash 104 into the closed position. In one option, the engagement portion 402 maintains a tight seal against the frame 102 during translation of the sash 104 into the closed position. In another option, the weather stripping 412 engages against the inner perimeter 301 of the frame 102 when the sash 104 is moved to the closed position. Optionally, the weather stripping 412 and screen assembly 300 complement one another and substantially protect the drive mechanisms and the inside of a home from the elements, when the sash 104 is in the closed position. Moreover, screen assemblies 602, 1002 are operated between the sash 104 and the frame 102 in a similar manner to screen assembly 300. In the example of screen assembly 1002, the spring member 1012 provides the restoring force for moving the engagement portion 1004 into continuous sliding engagement with the inner perimeter 301 of the frame 102 (FIGS. 10A, B).

In another option, the screen assembly 800 includes a deformable foam membrane 804 having an engagement portion 806. In one option, the deformable foam membrane 804 extends substantially around the sash 104. In another option, the deformable character of the foam membrane 804 provides the spring member restoring force. As the sash 104 is translated within the frame 102 the expansive restoring force of the foam membrane 804 continually engages the engagement portion 806 to the frame 102. The foam membrane 804 is engaged against the frame 102, for example, in the open position, closed position and intermediate positions. In another option, the screen assembly 800 includes weather-stripping 412. When in the closed position the weather-stripping 412 engages against the frame 102. In one option, the weather-stripping 412 and screen assembly 800 cooperatively protect the window assembly 100 drive mechanisms and the inside of a home from exposure to the elements, when the sash is in the closed position.

Optionally, the screen assembly 900 includes a jacket 914 surrounding at least part of a deformable foam membrane 910. In one option, the deformable foam to membrane 910 extends substantially around the sash 104 (FIG. 1). In another option, the deformable character of the foam membrane 804 provides the spring member restoring force. As the sash 104 is translated within the frame 102 (FIG. 1) the expansive restoring force of the foam membrane 910 continually engages the engagement portion 912 to the frame 102. The hook 908 and the flange 916 grasp the jacket 914, in one option. The hook 908 and the flange 916 cooperate to ensure the foam membrane 910 extends away from the support panel 102 so the foam membrane 910 is coupled between the sash 104 and the frame 102. The foam membrane 910 is slidably engaged against the frame 102, for example, in the open position, closed position and intermediate positions.

Figure 12:
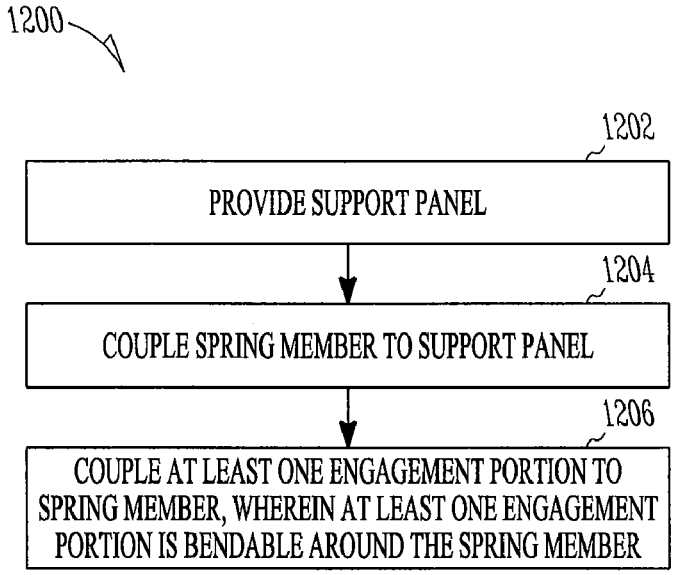
FIG. 12 is a block diagram illustrating one example of a method of making a screen assembly.

FIG. 12 describes a method 1200 for making a screen assembly. At 1202, a support panel is provided. At 1202, a spring member is coupled to the support panel. At 1204, at least one engagement portion is coupled to the spring member. In one option, the spring member is deformable and applies a restoring force to the at least one engagement portion and the engagement portion is bendable around the spring member.

Several options for the method 1200 follow. In one option, the support panel includes a deformable projection extending along a length of the support panel, and the deformable projection is dimensioned and configured to interference fit within a sash channel. In another option, the method 1200 includes coupling a second engagement portion to the spring member. Optionally, a foam plug is coupled between the at least one engagement portion and the second engagement portion. In still another option, openings are formed in the at least one engagement portion. Screen material (e.g. wire mesh screens) is coupled to the at least one engagement portion, in one option, wherein the screen material is disposed within the openings. In another option, the engagement portion is integral to the spring member. Optionally, the engagement portion is coated with a deformable coating.

Figure 13:
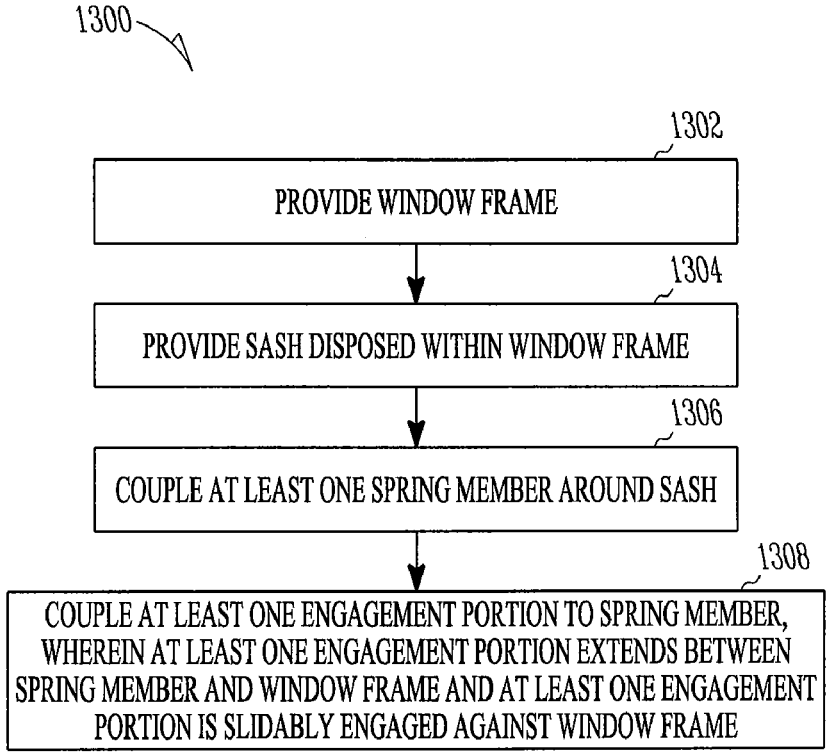
FIG. 13 is a block diagram illustrating one example of a method of making a window assembly.

FIG. 13 is a block diagram illustrating a method 1300 for making a window assembly. At 1302, a window frame is provided. At 1304, a sash is disposed within the window frame. At least one spring member is coupled around the sash, as shown at 1306. At 1308, at least one engagement portion is coupled to the spring member. In one option, the at least one engagement portion extends between the spring member and the window frame and the at least one engagement portion is slidably engaged against the frame.

Several options for the method 1300 follow. In one option, the sash has at least one corner. Optionally, a second engagement portion is coupled to the spring member, and the at least one engagement portion and the second engagement portion extend along the window frame from the at least one corner. In another option, a foam plug is coupled between the at least one engagement portion and the second engagement portion. In yet another option, the foam plug extends from the sash to the frame. Optionally, the method 1300 includes forming a foam membrane and at least one of the engagement portion and the spring member include a deformable foam membrane. In still another option, openings are formed in the at least one engagement portion. Screen material (e.g. interlaced mesh screen material) is coupled to the at least one engagement portion, in one option. Optionally, the screen material is disposed within the openings (e.g. the material of the engagement portion is folded over the screen material). In another option, the interlaced screen material is disposed over or under the openings. The method 1300 further includes, in yet another option, surrounding at least a portion of the foam membrane with a jacket.

In another option, coupling the at least one spring member around the outer perimeter of the sash includes coupling the at least one spring member to a support panel. Optionally, the method 1300 includes coupling the support panel to the sash. In one option, a deformable projection coupled to the support panel is disposed within a channel extending around the outer perimeter of the sash.

The screen assembly described herein provides an effective barrier against insects, leaves or the like, while allowing ventilation around the sash. The screen assembly is compact and does not require additional storage space when the sash is in a closed position. Additionally, when closed, the screen assembly is concealed between the sash and the frame. Thus, the screen assembly does not alter the aesthetics of the window. Moreover, in another option, the screen assembly is preinstalled in a window assembly as a single unit. Installation of the window assembly provides a ready to use window with a screen assembly.

In one option, the screen assembly includes a spring member and an engagement portion coupled to the spring member. In another option, the spring member is coupled to an outer perimeter of the window sash. In yet another option, the engagement portion extends from the spring member and is slidably engaged to an inner perimeter of the window frame. When the sash is translated with respect to the window frame the engagement portion slidably moves along the inner perimeter of the frame, in still another option. The engagement portion is retained against the frame by the restoring force applied by the spring member. Optionally, the engagement portion extends around the sash and provides a substantially continuous screen between the sash and the frame. In another option, the screen assembly includes a foam membrane coupled to the sash. In one option, the foam membrane extends from the sash and an engagement portion of the foam membrane is slidably coupled to the inner perimeter of the frame. Compression of the foam membrane, in intermediate, closed and open positions, creates an expansive restoring force that continually and slidably engages the engagement portion of the foam membrane against the frame. Coupling the screen assembly to the sash and slidably coupling the engagement portion to the frame reduces manufacturing and labor costs because affixing the engagement portion to the frame is unnecessary.

Moreover, openings are formed in the screen assembly to allow ventilation. In one option, the openings are small enough to prevent the ingress of insects, leaves, dust or the like. In another option, the openings are covered with a screen material (e.g. interlaced mesh). The continuous sliding engagement of the engagement portion to the frame cooperates with the openings to prevent insect ingress while allowing ventilation around the window.

It is to be understood that the above description is intended to be illustrative, and not restrictive. Many other embodiments will be apparent to those of skill in the art upon reading and understanding the above description. It should be noted that embodiments discussed in different portions of the description or referred to in different drawings can be combined to form additional embodiments of the present application. The scope of the invention should, therefore, be determined with reference to the appended claims, along with the full scope of equivalents to which such claims are entitled.

What is claimed is:

1. A window assembly comprising:

a frame movably coupled with a sash, the sash including a plurality of stiles and rails joined at corners with a pane therein;

one or more deformable screens coupled between the frame and the sash, the one or more deformable screens to extend between the frame and the sash in both a window open position and a window closed position, with at least one of the deformable screens including a biasing member and an engagement portion movably engaged lengthwise against at least one of the frame or the sash and between at least two ends, the biasing portion and the engagement portion extending along the stiles and rails; and at least one deformable plug coupled between at least two ends of the engagement portion, the at least one deformable plug to extend between the frame and the sash in both the window open position and the window closed position, with the one or more deformable screens coupled with the at least one deformable plug in both the window closed position and the window open position.

2. The window assembly of claim 1, wherein the biasing member rotates and seals the engagement portion against at least one of a frame perimeter or a sash perimeter.

3. The window assembly of claim 1, wherein the at least one deformable plug comprises a foam plug coupled at the corners.

4. The window assembly of claim 1, wherein the biasing member includes a foam membrane extending between the engagement portion and the sash.

5. The window assembly of claim 1, wherein the deformable screen includes a support panel having a coupling feature, and the coupling feature couples the support panel with at least one of the frame or the sash, and the biasing member is remote from the coupling feature.

6. The window assembly of claim 5, wherein the engagement portion folds over a space between the biasing member and the coupling feature when the sash is in the window closed position.

7. The window assembly of claim 1, wherein the engagement portion includes a deformable coating.

8. A window assembly comprising:

a horizontally projecting window sash, the window sash including at least one corner;

a frame coupled around the window sash, the window sash movable between a closed position and an open position, and the window sash is generally parallel with the frame in the closed position and the open position;

one or more deformable screens including:

at least one biasing member coupled with at least one of the frame or the window sash;

a plurality of engagement portions, each extending lengthwise a length that extends between two end portions, with each of the plurality of engagement portions terminating at the end portions, with at least one engagement portion coupled with the biasing member, with the length of the at least one engagement portion movably coupled along the other of the frame and the window sash, the at least one biasing member forming a perimeter around at least one of the frame or the window sash; and at least one deformable plug coupled between at least two end portions of the one or more deformable screens, the at least one deformable plug to extend between the frame and the sash in both the window open position and the window closed position, with the one or more deformable screens coupled with the at least one deformable plug in both the window open position and the window closed position.

9. The window assembly of claim 8, wherein the at least two end portions that are coupled meet at the at least one corner.

10. The window assembly of claim 9, wherein the biasing member seals the engagement portion against at least one of the frame or the window sash at the corner.

11. The window assembly of claim 10, wherein the deformable plug comprises at least one foam plug, and the foam plug extends from the window sash to the frame.

12. The window assembly of claim 8, wherein the biasing member and the engagement portion include a foam membrane disposed around an outer perimeter of the window sash and extending to the frame.

13. The window assembly of claim 12, further comprising a jacket surrounding at least part of the foam membrane, wherein the jacket is slidably coupled to the frame.

14. The window assembly of claim 8, wherein the biasing member includes a leaf spring.

15. The window assembly of claim 8, wherein the engagement portion includes at least one opening.

16. The window assembly of claim 15, wherein the at least one opening includes a screen material.

17. A method for making a window assembly comprising:

movably coupling a horizontally projecting sash with a frame;

with a biasing member, biasing one or more deformable screens coupled to one of the frame and the sash against and along the other of the frame and the sash along the frame perimeter and the sash perimeter;

when opening and closing the window, sliding an engagement portion of each deformable screen along the other of the frame and the sash, the engagement portion extending lengthwise along one of the frame and the sash between ends of the engagement portion;

sealing a gap between the sash and the frame by disposing each engagement portion against and along the other of the frame and the sash, with each of the one or more deformable screens substantially filling the gap; and filling portions of the gap between adjacent end portions by coupling a deformable plug between at least two ends, the engagement portion sealed with a restoring force applied by the biasing member, the deformable plug expanding to fill the portions of the gap between adjacent ends.

18. The method for making the window assembly of claim 17, wherein sealing includes disposing the engagement portion over at least one of the sash corner or a frame corner.

19. The method for making the window assembly of claim 17, wherein the deformable plug comprises a foam plug.

20. The method for making the window assembly of claim 17, wherein sliding the engagement portion includes freely and slidably engaging a foam membrane against the other of the frame perimeter or the sash perimeter, and wherein the foam membrane includes the biasing member.

21. The method for making the window assembly of claim 17 further comprising forming at least one opening in the engagement portion.

22. The method for making the window assembly of claim 21, wherein forming the at least one opening includes disposing a screen material within the opening.

23. The method for making the window assembly of claim 17, wherein coupling the biasing member of the deformable screen along at least one of the frame perimeter or the sash perimeter includes coupling a support panel with a coupling feature to at least one of the frame or the panel, and the biasing member is remote from the coupling feature.

24. The method for making the window assembly of claim 23 further comprising folding the engagement portion along a space between the coupling feature and the biasing member when the panel is in a closed position.

25. A window assembly comprising:

a frame movably coupled with a sash, the sash including a plurality of stiles and rails joined at corners with a pane therein;

one or more deformable screens coupled between the frame and the sash, the one or more deformable screens to extend between the frame and the sash in both a window open position and a window closed position, with at least one of the deformable screens including a biasing member and an engagement portion extending lengthwise a length that extends between at least two end portions, the length of the engagement portion movably engaged against at least one of the frame or the sash, the biasing portion and the engagement portion extending along the stiles and rails; and wherein at least one foam plug is coupled between at least two ends of the engagement portion at the corners, and the foam plug extends from the sash to the frame in both the sash open position and the window closed position, with the one or more deformable screens coupled with the at least one deformable plug extending between the frame and the sash in both the window closed position and the sash open position.

26. A window assembly comprising:

a horizontally projecting window sash, the window sash including at least one corner;

a frame coupled around the window sash, the window sash movable between a closed position and an open position, and the window sash is generally parallel with the frame in the closed position and the open position; and one or more deformable screens including:

at least one biasing member coupled with at least one of the frame or the window sash; and at least one engagement portion coupled with the biasing member and movably coupled along the other of the frame and the window sash, the at least one biasing member forming a perimeter around at least one of the frame or the window sash, with each engagement portion including a length that extends between two ends;

wherein the engagement portion has at least two ends at the at least one corner, wherein the biasing member seals the engagement portion length against at least one of the frame or the window sash at the corner, and wherein the biasing member and the engagement portion include at least one foam plug coupled to the at least two ends, the at least one foam plug extends therebetween, and the foam plug extends from the window sash to the frame in both the open position and the closed position.

27. A window assembly comprising:

a frame defining an opening, the opening having an inner perimeter;

a sash having a sash perimeter, the sash movably coupled to the frame, the inner perimeter and the sash perimeter in parallel in a window open position defining an air passage between the frame and the sash, the air passage extending substantially along the inner perimeter, and a hinged screen coupled to one of the frame and the sash and extending substantially along the inner perimeter, the hinged screen biased against the other of the frame and the sash and extending between the frame and the sash in the window open position, wherein the hinged screen includes two engagement portions having a first rigidity, and a deformable plug coupling the two engagement portions to one another, the deformable plug having a rigidity that is less than the first rigidity.

28. The window assembly of claim 27, wherein the sash perimeter is substantially rectangular, with the first engagement portion extending along a first side, and the second engagement portion extending along a second side adjacent the first side, with the deformable plug coupling the two engagement portions proximal a corner of the sash perimeter.

* * * * *